US005685017A

United States Patent [19]

Kraft

[11] Patent Number: 5,685,017

[45] Date of Patent: Nov. 11, 1997

[54] MODULAR HAT

[76] Inventor: David Kraft, 570 Yuma Ct., Boulder, Colo. 80301

[21] Appl. No.: 620,243

[22] Filed: Mar. 22, 1996

[51] Int. Cl.[6] ..... A42B 1/04

[52] U.S. Cl. ..... 2/171.1; 2/10; 2/172; 2/181; 2/181.4; 2/195.1; 2/209.12; 2/209.13

[58] Field of Search ..... 2/10, 171.1, 171.4, 2/171.5, 172, 175.1, 175.2, 181, 181.2, 181.4, 183, 195.1, 209, 209.11, 209.12, 209.13, 209.3, 209.4

[56] References Cited

U.S. PATENT DOCUMENTS

| | | | |
|---|---|---|---|
| D. 237,758 | 11/1975 | Huffman | D2/244 |
| 946,770 | 1/1910 | Sands . | |
| 1,114,400 | 10/1914 | Slotoroff | 2/195.1 |
| 1,194,193 | 8/1916 | Kronthal | 2/181 |
| 1,816,346 | 7/1931 | Silverstein | 2/209.12 |
| 3,268,911 | 8/1966 | Cox . | |
| 4,484,363 | 11/1984 | Varanese | 2/209.1 |
| 4,630,317 | 12/1986 | Brown et al. | 2/12 |
| 4,776,044 | 10/1988 | Makins | 2/199 |
| 5,046,195 | 9/1991 | Koritan | 2/172 |
| 5,070,545 | 12/1991 | Tapia | 2/195 |
| 5,099,524 | 3/1992 | Linday | 2/181 |
| 5,121,507 | 6/1992 | Brown | 2/199 |
| 5,161,259 | 11/1992 | Shorts | 2/199 |
| 5,253,368 | 10/1993 | Blake | 2/209.13 |
| 5,351,343 | 10/1994 | Harbison | 2/172 |
| 5,428,844 | 7/1995 | Dougherty | 2/181.4 |
| 5,437,962 | 8/1995 | Douglas | 2/195.1 |

FOREIGN PATENT DOCUMENTS

| | | | |
|---|---|---|---|
| 2070413 | 9/1981 | United Kingdom | 2/209.12 |
| 2240029 | 7/1991 | United Kingdom | 2/10 |

*Primary Examiner*—Diana Biefeld
*Attorney, Agent, or Firm*—Aquilino & Welsh

[57] ABSTRACT

A modular hat including a headband shaped to fit about the circumference of an individual's head. The headband includes an inner-surface and an outer-surface, wherein headband connecting members are provided on the inner-surface of the headband for releasable securing at least one hat component thereto. The at least one hat component is chosen from the group consisting of a hat crown, an interchangeable hat crown, a visor, a neck curtain, a pair of ear muffs and a utility strap.

20 Claims, 8 Drawing Sheets

MODULAR HAT

BACKGROUND OF THE INVENTION

1. Field of the Invention

This invention relates to modular hats. More particularly, the invention relates to modular hats including a wide-range of components for selective attachment to a base headband.

2. Description of the Prior Art

Hats have always been a very popular addition to the clothing worn by individuals. Hats have principly been worn for functional reasons, for example, to keep an individual's head warm or to protect an individual's face from the sun. However, hats have also been used as a stylish accessory to the clothing worn by an individual. For this reason, hats are available with wide brims and neck curtains providing protection from the sun, with insulated crowns and ear muffs providing protection from the cold, and in a wide variety of colors and styles fulfilling the aesthetic demands of the public. Since the majority of these hats are designed for a specific purpose and are not readily adaptable, people must purchase a wide variety of hats to meet their functional and stylistic needs.

With this in mind, adaptable hats, permitting an individual to add and remove components from a base hat, have been known for some time. These hats may, for example, permit an individual to add different visors or neck curtains to the hat. These hats may also permit the selective addition and removal of different hat crowns, emblems, or other components.

The provision of hats that may be readily modified provides individuals with the ability to modify their hats based upon outdoor conditions or simply a change of mood. As a result, an individual need not purchase an excessive number of hats to meet the wide variety of needs he or she may have.

However, prior convertible hats are limited in the versatility provided to wearers. For example, a hat may provide the ability to apply a variety of visors thereto, but not provide the ability to apply a variety of hat crowns thereto. Similarly, prior convertible hats might permit different hat crowns to be applied thereto, but not permit the panels of a specific hat crown to be interchanged. In addition, the manner in which the components are secured to the base hat is often cumbersome and insecure in prior convertible hats. This limits the usefulness of the hats, since individuals must consistently be concerned whether the attached components will in fact fall from the base hat.

In view of the shortcomings of prior convertible hats, a modular hat providing complete versatility with a secure attachment mechanism is needed. The present modular hat provides for an unlimited range of versatility in a convenient, reliable, easy to use, and inexpensive modular design.

SUMMARY OF THE INVENTION

It is, therefore, an object of the present invention to provide a modular hat. The modular hat includes a headband shaped to fit about the circumference of an individual's head. The headband includes an inner surface and an outer surface, wherein a headband connecting member is provided on the inner surface of the headband for releasable securing at least one hat component thereto. The at least one hat component is chosen from the group consisting of a hat crown, an interchangeable panel crown, a visor, a neck curtain, a pair of ear muffs and a utility strap.

In addition, it is an object of the present invention to provide a modular hat wherein the interchangeable panel crown is shaped to fit on the head of an individual and includes a plurality of straps connected in an intersecting manner to create a plurality of open crown segments.

It is further an object of the present invention to provide a modular hat wherein a plurality of panels are included for attachment to the interchangeable panel crown in a manner covering the open crown segments. Panel connecting members are provided for releasable securing the plurality of panels to the straps of the interchangeable panel crown.

It is also an object of the present invention to provide a modular hat with an interchangeable panel crown including a closed end and an opened end, wherein the crown further includes a hat crown connecting member secured at the open end of the hat crown for attachment to the headband connecting member in a manner permitting the crown to extend from the headband.

Another object of the invention is the provision of a interchangeable panel crown including a closed end and an opened end, wherein the crown includes a hat crown connecting member secured at the opened end of the hat crown for attachment of the plurality of panels.

A further object of the present invention is the provision of a modular hat wherein the headband is adjustable, permitting use by individuals with a variety of head sizes.

It is also an object of the present invention to provide a modular hat having a visor including an outwardly extending visor member. The visor includes a distal end extending away from the headband when the visor is secured to the headband and a proximal end adjacent to the headband when the visor is secured to the headband. The visor further includes a visor connecting member secured to the proximal end of the visor member for attachment to the headband connecting member in a manner permitting the visor to extend from the headband.

Another object of the present invention is the provision of a modular hat including a pair of ear muffs. Each of the ear muffs includes a distal end extending downwardly over an ear of an individual when the ear muff is secured to the headband and a proximal end adjacent the headband when the ear muff is secured to the headband. Each ear muff further includes an ear muff connecting member secured to the proximal end of the ear muff for attachment to the headband connecting member in a manner permitting the ear muff to extend from the headband.

It is also a further object of the present invention to provide a modular hat wherein the crown is shaped to fit over the head of an individual and includes an open end having a crown connecting member secured thereto for attachment to the headband connecting member in a manner permitting the crown to extend from the headband.

Another object of the present invention is the provision of a modular hat including a neck curtain. The neck curtain includes a distal end extending downwardly over the neck of an individual when the neck curtain is secured to the headband and a proximal end adjacent the headband when the neck curtain is secured to the headband. The neck curtain further includes a neck curtain connecting member secured to the proximal end of the neck curtain for attachment to the headband connecting member in a manner permitting the neck curtain to extend from the headband.

It is a further object of the present invention to provide a modular hat including a utility strap having a first end, a second end, a first side and a second side. The utility strap further includes a first utility strap connecting member secured at the first end and first side and a second utility strap connecting member secured at the second end and second side. The first and second utility strap connecting members are provided for attachment to the headband connecting member in a manner permitting an individual to carry a desired object.

It is another object of the present invention to provide a modular hat wherein the utility strap is capable of carrying objects chosen from the group consisting of calculators, pens, note pads, pagers, phones, portable televisions, ear phones, microphones, camera, flash lights, stop watches, and daily medications.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
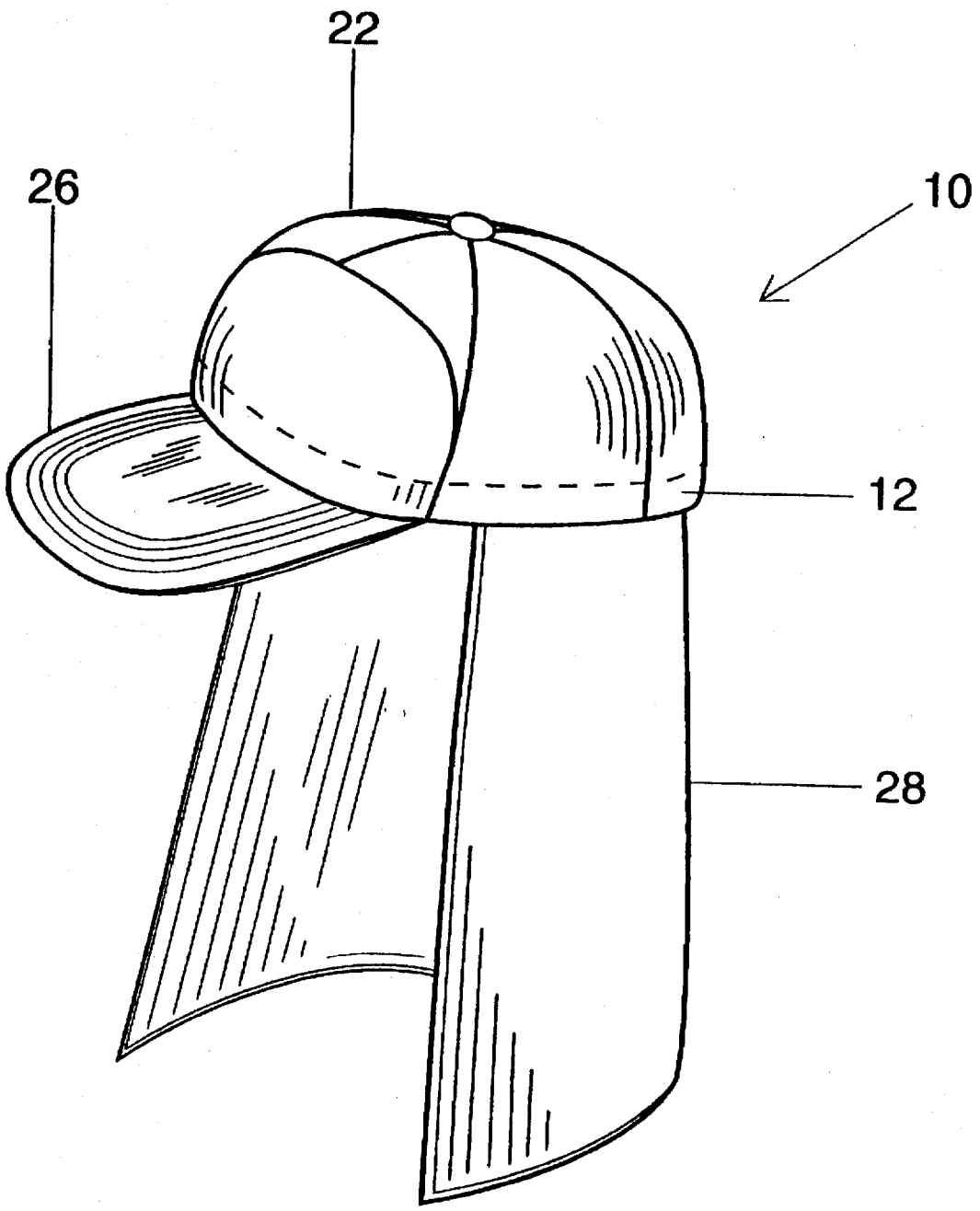
FIG. 1 is a perspective view of the modular hat with a neck curtain.
Figure 2:
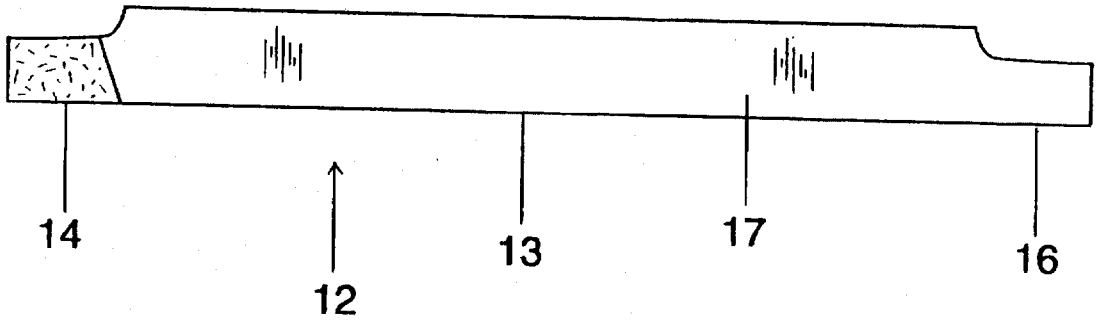
FIG. 2 is a front view of the outer surface of the unassembled headband.
Figure 3:
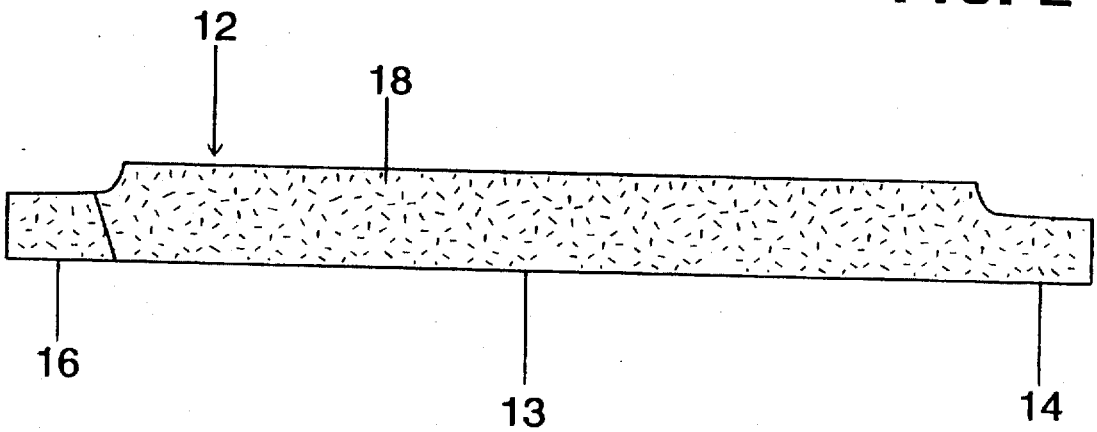
FIG. 3 is a front view of the inner surface of the unassembled headband.
Figure 4:
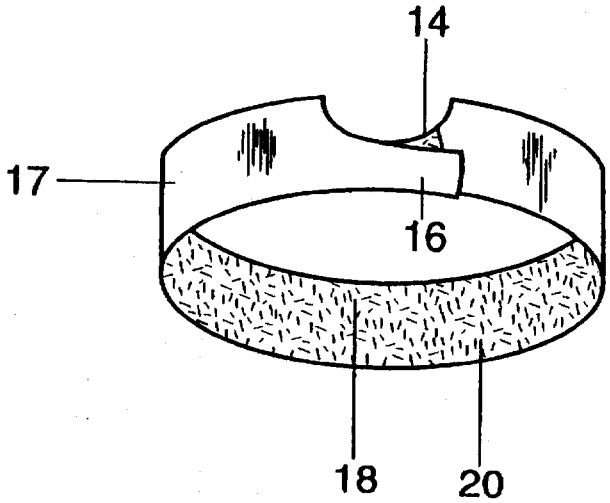
FIG. 4 is a perspective view of the headband.

With reference to FIG. 1, a modular hat is shown. The modular hat 10 includes a headband 12 shaped to fit about the circumference of an individual's head. As shown in FIGS. 2–4, the headband 12 is constructed from a strap 13 of material having a first end 14 and a second end 16 that are releasable secured together in manner permitting the circumference of the headband to be varied to accommodate individuals having a variety of head sizes. The first and second ends of the strap 13 are secured together by VELCRO, hook and loop type material, wherein the first end 14 is provided with the hook material on the outer suface 17 and the second end 16 is provided with the loop material on the inner surface 20.

The headband 12 further includes a headband connecting member 18 secured on the inner surface 20 of the strap 13. The connecting member 18 is preferably a strip of the loop material utilized in VELCRO. The strip extends the length of the strap 13 to permit the attachment of a wide variety of hat components at different locations about the circumference of the headband. It should be understood that VELCRO hook and loop type connecting material is utilized as the connecting material in the preferred embodiment of the invention, although other releasable connecting materials could be used in accordance with the present invention.

As stated previously, the headband connecting member 18 secured on the inner surface 20 of the headband 12 permits the attachment of a wide variety hat components thereto. The hat components are chosen from the group consisting of a hat crown 22, an interchangeable panel hat crown 24, a visor 26, a neck curtain 28, a pair of ear muffs 30, and a utility strap 32.

Figure 5:
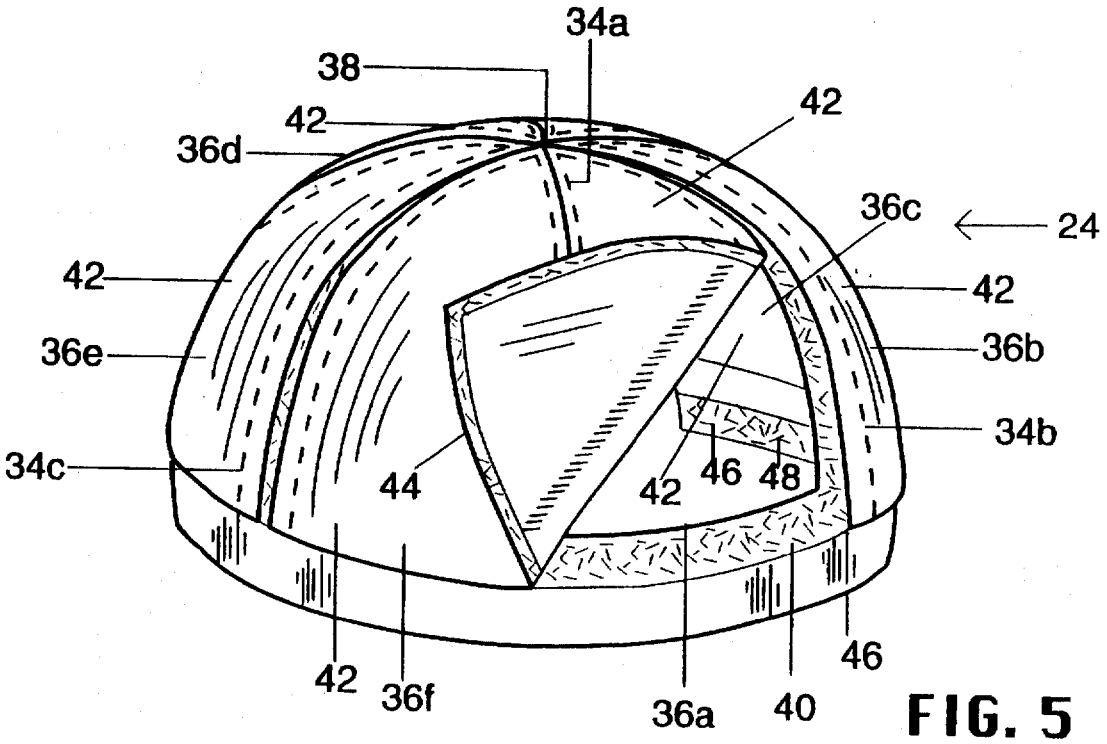
FIGS. 5 and 6 are perspective views of the interchangeable panel hat crown.
Figure 6:
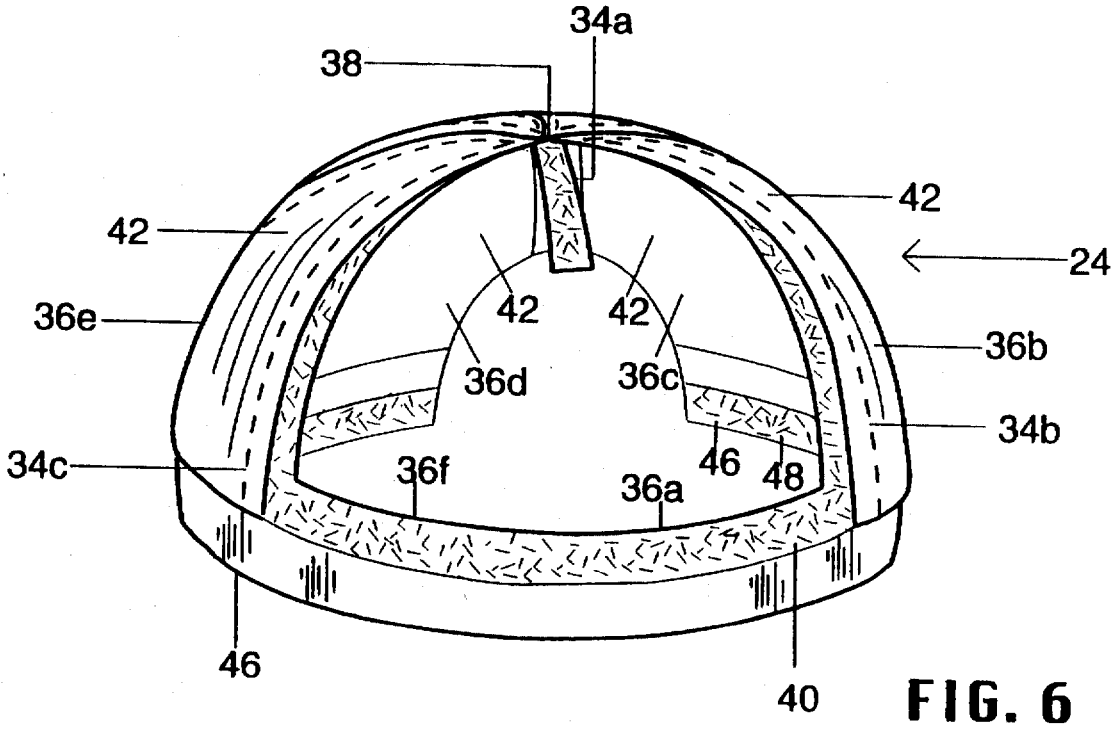

With regard to the interchangeable panel hat crown 24, your attention is directed to FIGS. 5 and 6. The interchangeable panel hat crown 24 is shaped to fit on the head of an individual and includes a plurality of straps 34*a*, 34*b*, 34*c* connected in an intersecting manner to create a plurality of open crown segments 36*a*–36*f*. The straps 34*a*, 34*b*, 34*c* are preferably connected to form a star, wherein the straps 34*a*, 34*b*, 34*c* intersect in the middle 38 of the crown 24 and are connected at that point. Specifically, three straps 34*a*, 34*b*, 34*c* extend across the middle 38 of the crown 24 and are connected at their midpoints. This creates a star having six outwardly extending arms defining six triangular-shaped open crown segments 36*a*–36*f*. Four of the six outwardly extending arms are connected by a semi-circular strap 40 extending about the circumference of the crown 24. This permits the crown 24 to adapt when the size of the headband is varied to accommodate different head sizes.

The straps 34*a*, 34*b*, 34*c* forming the star and the semi-circular strap 40 are VELCRO tape. The tape could be either the hook or loop side of the VELCRO tape, although the disclosed embodiment utilizes the hook side of the VELCRO tape. The straps forming the star and the semi-circular strap are secured together such that the hooks of the VELCRO tape extend outwardly from the interior of the crown. This permits the releasable attachment of a variety of panels 42 to the crown. Specifically, a plurality of panels 42 are provided for attachment to the interchangeable panel hat crown 24 in a manner covering the open crown segments 36*a*–36*f*. The panels 42 are substantially triangular-shaped and include VELCRO tape 44 (loop side) on their outer edges permitting releasable attachment to the straps forming the crown. The panels may be sized to cover a single open crown segment or a plurality of open crown segments.

The plurality of panels 42 may be provided with a wide variety of different designs. The provision of releasable panels 42 permits the design of the crown to vary by simply replacing panels with other panels having different designs. The design feature of the panels calls for the display of information ranging from movie trivia to knowledge of sports statistics and legends.

The interchangeable panel hat crown 24 also includes a hat crown connecting member 46 secured to the semi-circular strap 40. The hat crown connecting member 46 is a VELCRO strap (preferably the hook portion thereby permitting it to engage the headband connecting member on the inner surface of the headband) and the connecting portion 48, hook portion, extends toward the interior of the crown 24. The hat crown connecting member 48 is secured to the semi-circular strap 40 and extends the same distance as the semi-circular strap 40. When an individual desires to secure the interchangeable panel hat crown 24 to the headband 12, the interchangeable panel hat crown 24 is positioned adjacent the headband with the semi-circular strap 40 outside of the headband 12 and the hat crown connecting member 46 is fold within the interior of the headband 12 so that the connecting portion 48 of the hat crown connecting member 46 is secured to the headband connecting member 18.

Figure 7:
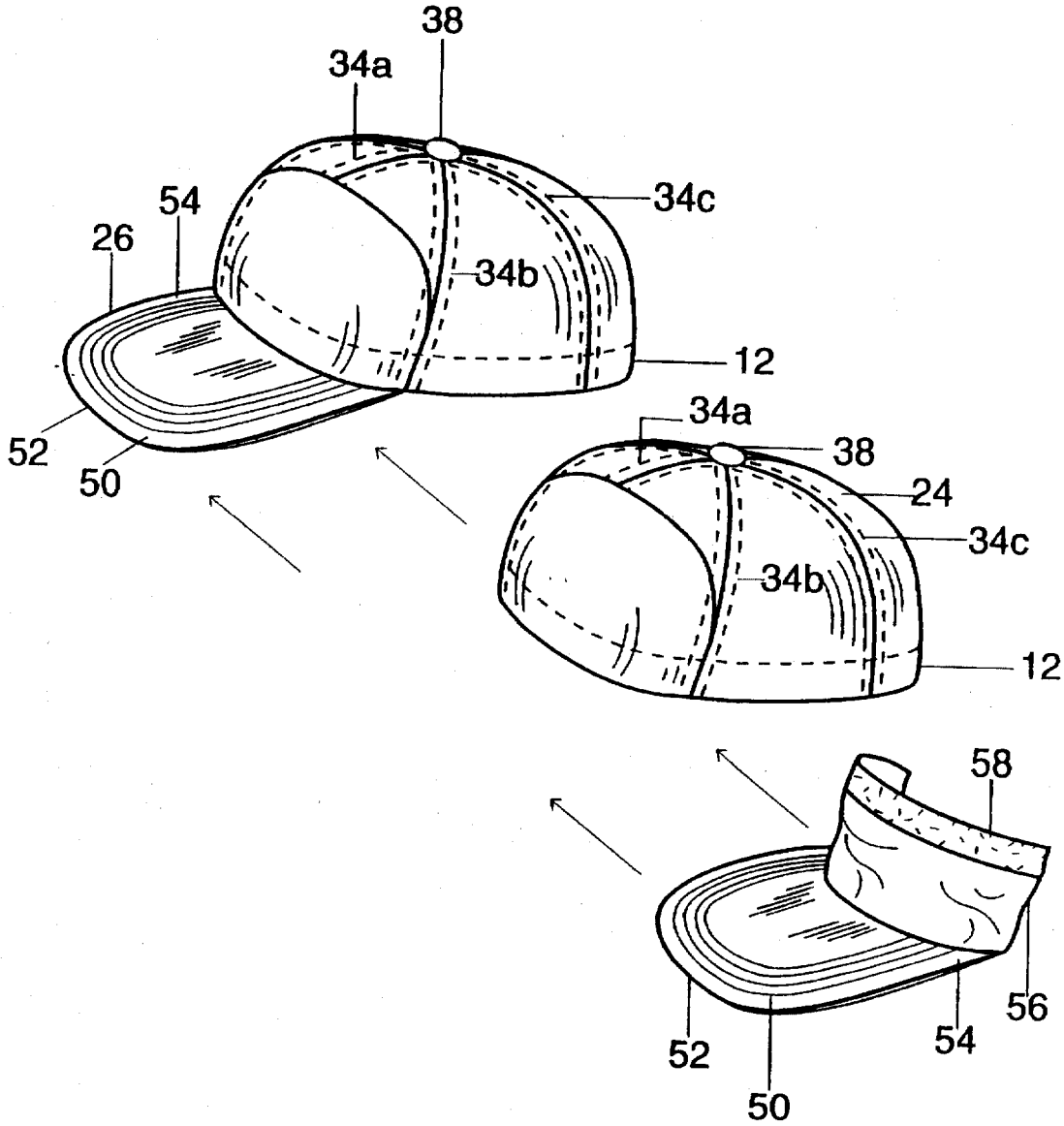
FIG. 7 is an assembly view showing the attachment of the visor.

With regard to the visor 26, your attention is directed to FIG. 7. The visor 26 includes an outwardly extending visor member 50 having a distal end 52 extending away from the headband 12 when the visor 26 is secured to the headband 12 and a proximal end 54 adjacent the headband 12 when the visor 26 is secured to the headband 12. The visor further including a visor connecting member 56 secured to the proximal end 54 of the visor member 50 for attachment to the inner surface 20 of the headband 12 in a manner permitting the visor 26 to extend from the headband 12. The visor connecting member 56 includes a sheet of material having VELCRO tape 58 secured thereto. Preferably, the VELCRO tape is the hook portion. In use, the visor 26 is positioned adjacent the headband 12, and the visor connecting member 56 is positioned on the interior of the headband 12 such that the VELCRO tape 58 can be releasable secure to the inner surface 20 of the headband 12.

Figure 8:
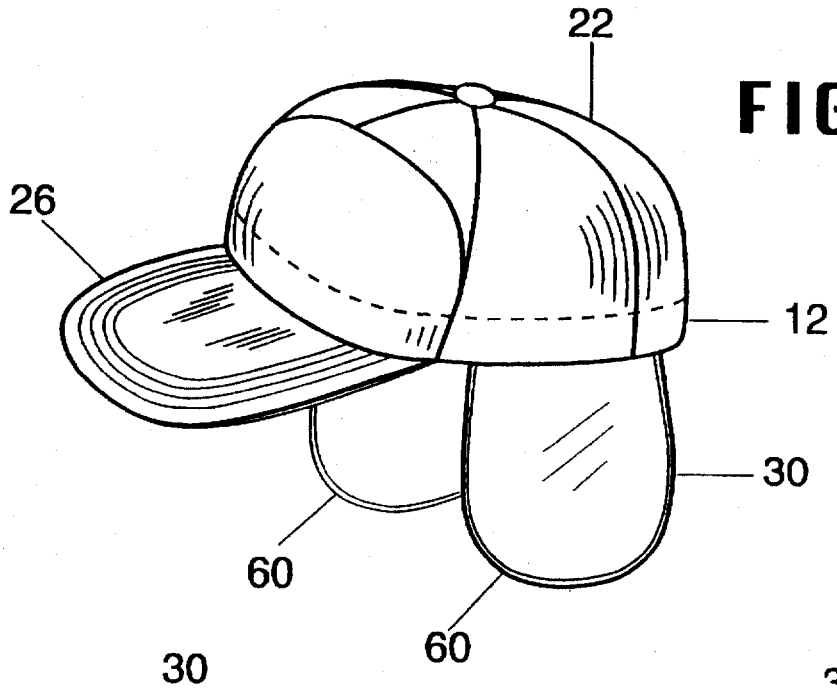
FIG. 8 is a perspective view of the hat with ear muffs.
Figure 9:
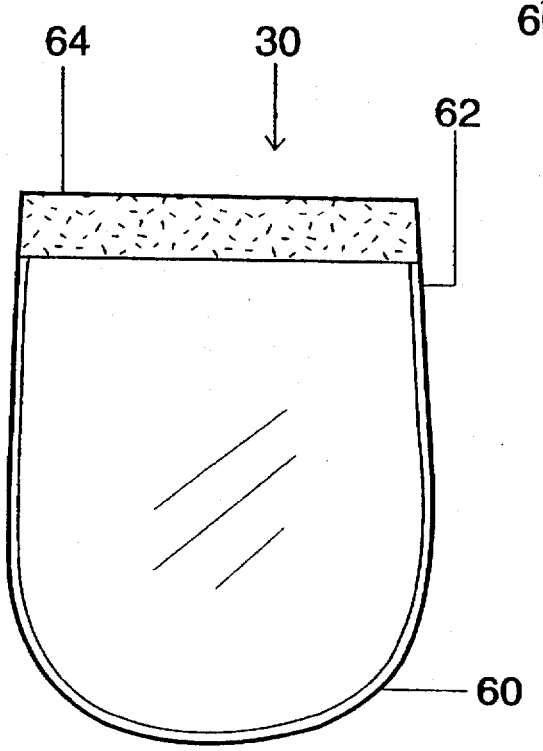
FIGS. 9 and 10 respectively show the front and back of the ear muff.
Figure 10:
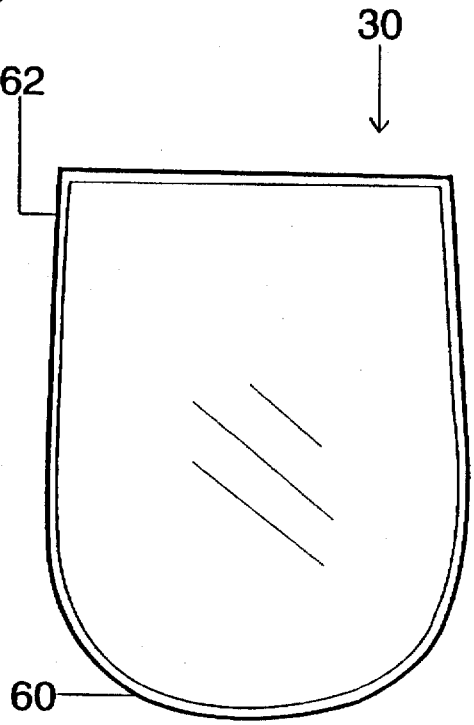

With regard to the ear muffs 30, your attention is directed to FIGS. 8–10. Each of the ear muffs 30 includes a distal end 60 extending downwardly over an ear of an individual when the ear muff 30 is secured to the headband 12 and a proximal end 62 adjacent the headband 12 when the ear muff 30 is secured to the headband 12. Each ear muff 30 further includes an ear muff connecting member 64 secured to the proximal end 62 of the ear muff 30 for attaching the ear muff 30 to the inner surface 20 of the headband 12 in a manner permitting the ear muff 30 to extend from the headband. The ear muff connecting member 64 is preferable a piece of the hook portion of VELCRO tape so that it can be releasable secured to the inner surface of the headband.

Figure 11:
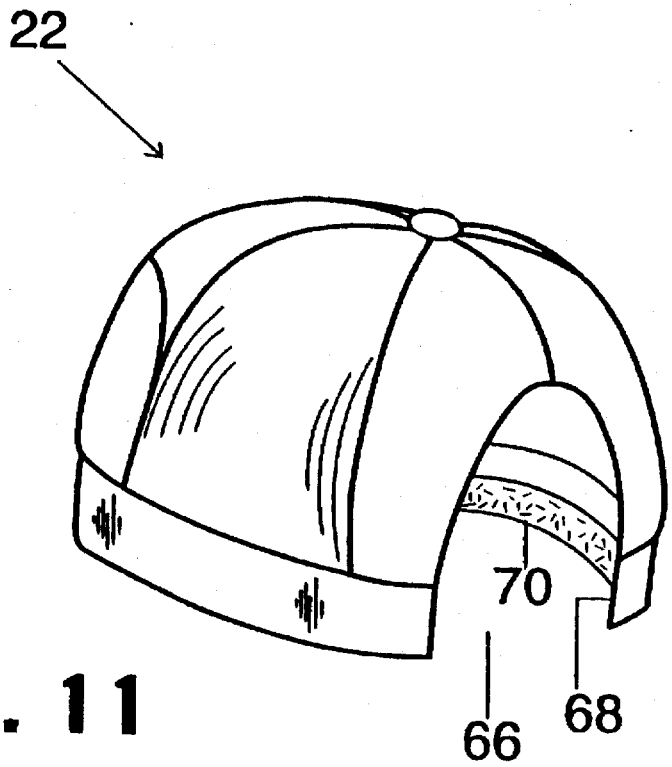
FIGS. 11 and 12 are views of the hat crown.
Figure 12:
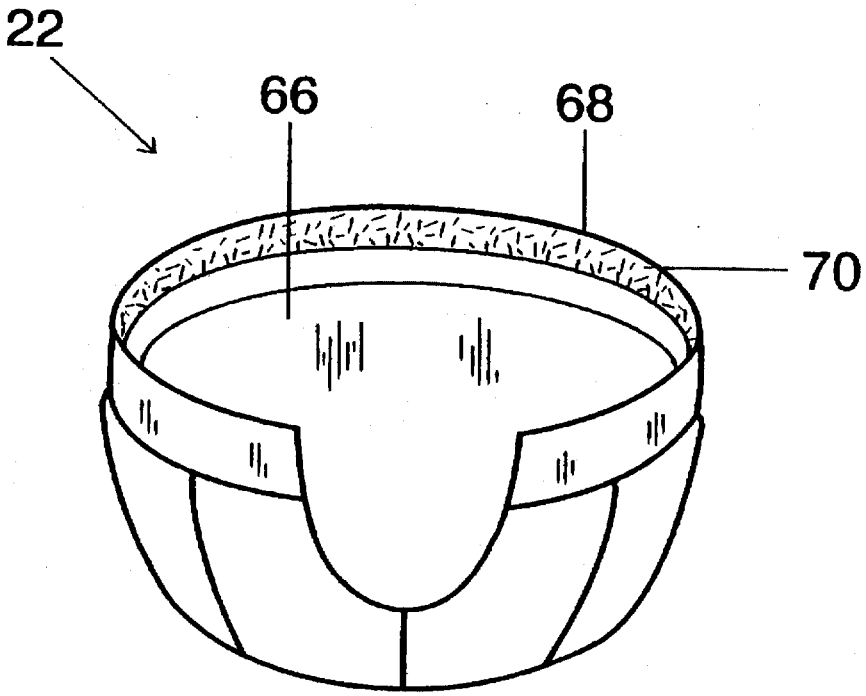

With regard to the hat crown 22, your attention is directed to FIGS. 11 and 12. The hat crown 22 is shaped to fit over the head of an individual and includes an open end 66 having a crown connecting member 18 secured thereto for attachment to the inner surface 20 of the headband 12 in a manner permitting the crown 22 to extend from the headband 12. The crown connecting member 68 is secured to the interior 70 at the open end 66 of the crown 22. The crown connecting member 68 is a strip of the hook portion of VELCRO tape. In use the crown 22 is position about the headband 12 and the crown connecting member 68 is folded within the interior of the headband 12. The crown connecting member 68 is then releasable secured to the inner surface 20 of the headband 12.

Figure 13:
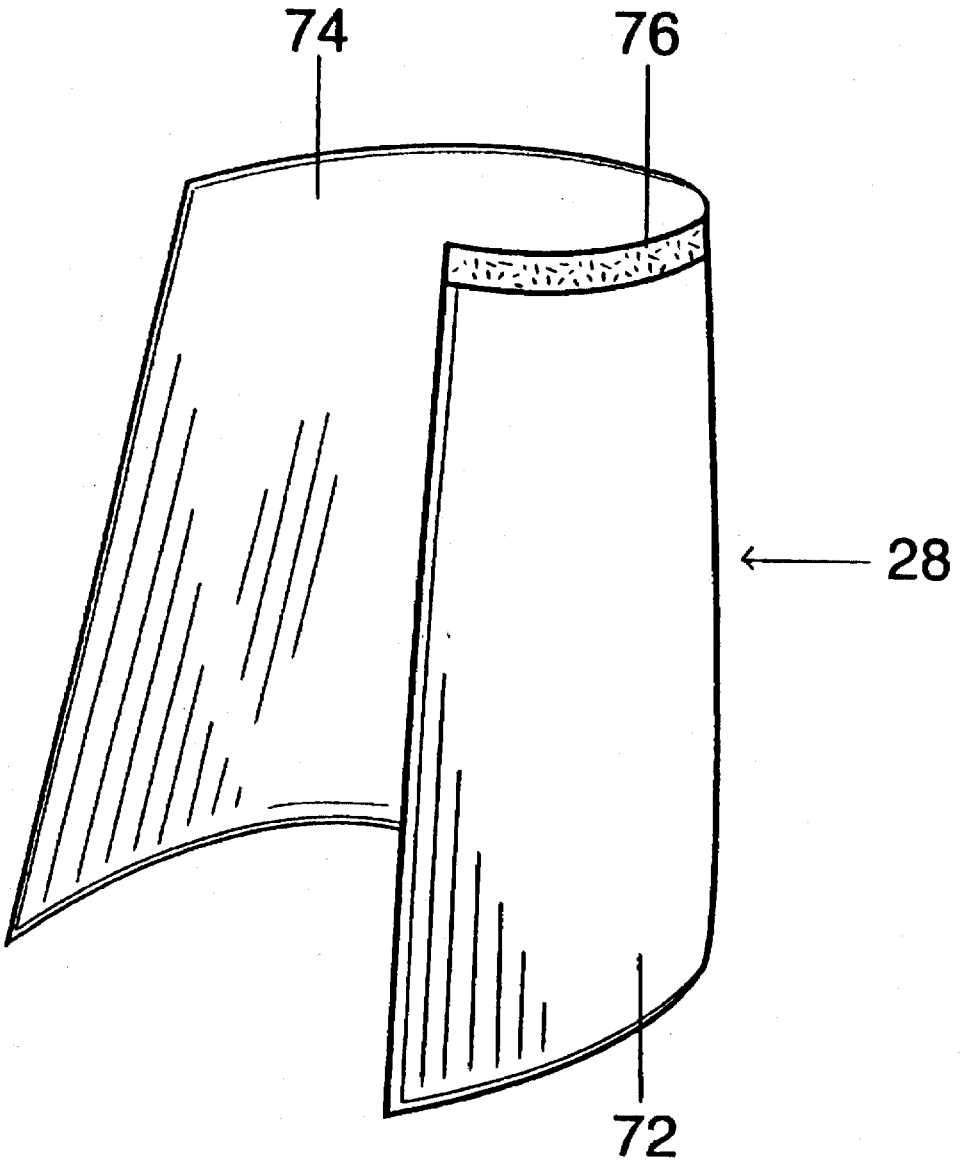
FIG. 13 is a perspective view of the neck curtain.

With regard to the neck curtain 28, your attention is directed to FIGS. 1 and 13. The neck curtain 28 includes a distal end 72 extending downwardly over the neck of an individual when the neck curtain 28 is secured to the headband 12 and a proximal end 74 adjacent the headband 12 when the neck curtain 28 is secured to the headband 12. The neck curtain 28 further includes a neck curtain connecting member 76 secured to the proximal end 74 of the neck curtain 28 for attachment to the inner surface 20 of the headband 12. Specifically, neck curtain connecting member 76 is preferable a piece of the hook portion of VELCRO tape so that it can be releasable secured to the inner surface 20 of the headband 12.

Figure 14:
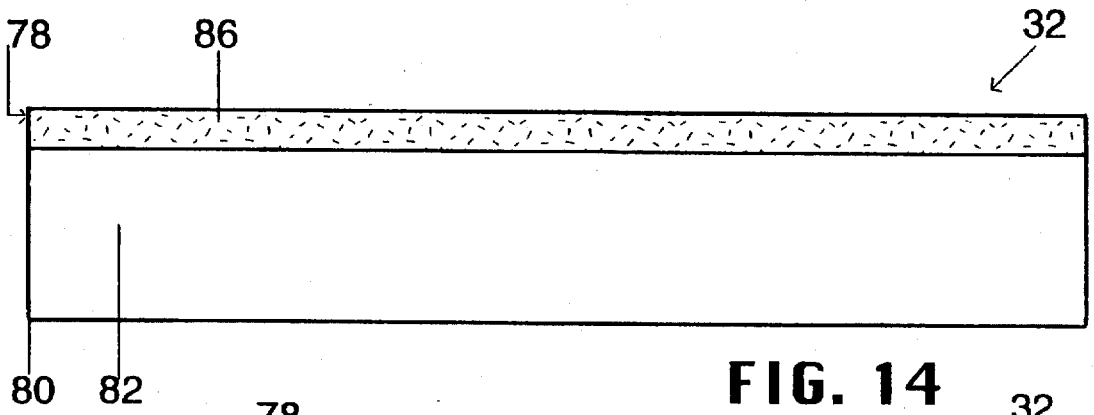
FIGS. 14, 15 and 16 are various views of the accessory strap.
Figure 15:
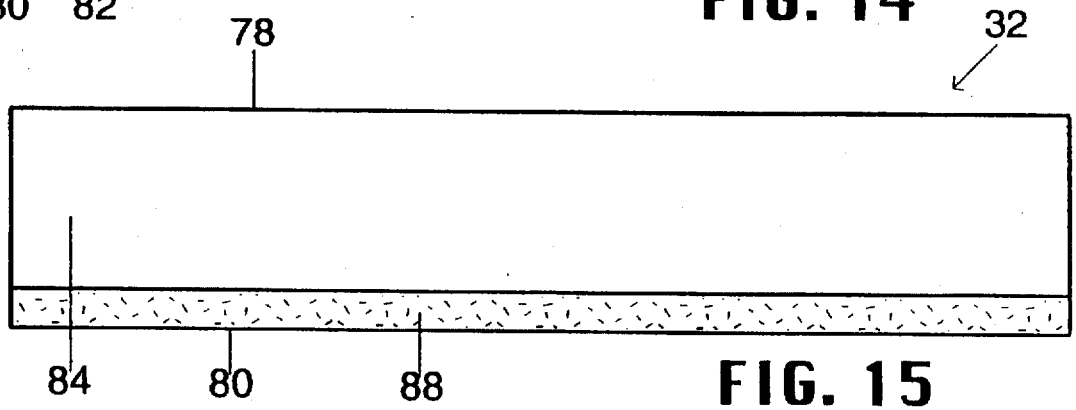
Figure 16:
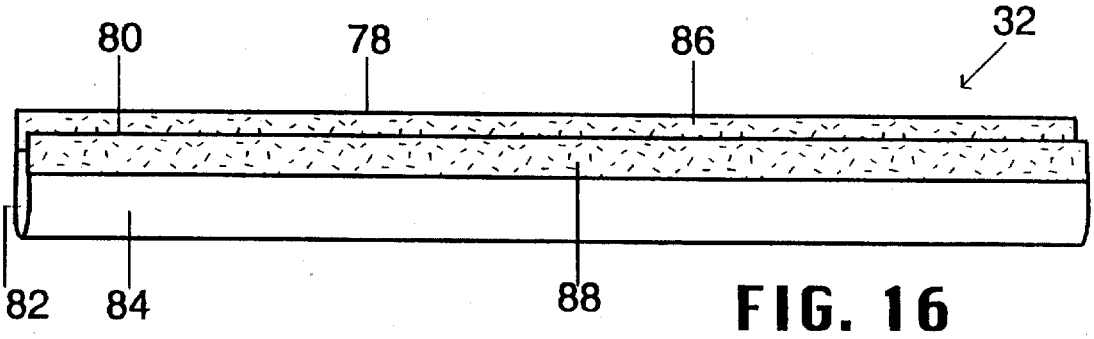

With regard to the utility strap 32 you attention is directed to FIGS. 14–16. The utility strap 32 includes a first end 78, a second end 80, a first side 82 and a second side 84. The utility strap 32 further includes a first utility strap connecting member 80 secured at the first end 78 and first side 82 and second utility strap 84 connecting member 88 secured at the second end 80 and second side 84. The first and second utility strap connecting members 86, 88 are preferably pieces of the hook portion of VELCRO tape and provide for attachment to the inner surface 20 of the headband 12 in a manner permitting and individual to carry a desired object. Specifically the utility strap is shaped to permit an individual to carry a wide variety of objects. The objects are chosen from the group consisting of calculators, pens, note pads, pagers, phones, portable televisions, ear phones, microphones, cameras, flashlights, stop watches, and daily medications.

The components discussed above can be attached to the headband in an unlimited variety, since the headband connecting member is thick enough to accommodate the attachment of more than one components at a time. It should also be understood that other components could be incorporated into the present invention, without departing from the spirit of the present invention.

The present modular hat expands traditional functions of today's head wear. The hat allows the removal and attachment of a variety of functional items to and from the headband. For example, when the headband is combined with a visor and a crown, a baseball hat is formed. Despite the outward appearance of an average hat, the internal design of the present hat allows a multiplicity of functional items to be used in any combination to adapt any style; that is, any combination of colored attachments, insignias or advertisements may be removably attached simultaneously or independently to the headband.

While the preferred embodiment has been shown and described, it will be understood that there is no intent to limit the invention by such disclosure, but rather, is intended to cover all modifications and alternate constructions falling within the spirit and scope of the invention as defined in the appended claims.

I claim:

1. A modular hat, comprising:

a headband a hat crown secured to the headband, the hat crown including a plurality of straps connected in an intersecting manner to create a plurality of open crown segments;

a plurality of panels for attachment to the hat crown in a manner covering the open crown segments, wherein connecting means are provided for readily and releasably securing the plurality of panels to the straps of the hat crown and readily detaching the plurality of panels from the straps of the hat crown without destroying or removing the connecting means.

2. The modular hat according to claim 1, wherein the headband is adjustable permitting use by individuals with a variety of head sizes.

3. The modular hat according to claim 1, further including a hat crown connecting member secured at an open end of the hat crown for attachment to a headband connecting member in a manner permitting the hat crown to extend from the headband.

4. The modular hat according to claim 3, wherein the hat crown connecting member is readily and releasably secured to the headband without destroying or removing the hat crown connecting member.

5. The modular hat according to claim 3, wherein the hat crown connecting member is semi-circular and extends around only a portion of the headband when the hat crown is secured to the headband.

6. The modular hat according to claim 1, wherein the panels are shaped to cover at least a single open crown segment.

7. The modular hat according to claim 1, wherein the straps intersect to create a plurality of triangle shaped open crown segments.

8. The modular hat according to claim 7, wherein the panels are shaped to cover a single open crown segment.

9. A modular hat, comprising:

a headband shaped to fit about the circumference of an individual's head including an inner surface and an outer surface, the headband further including a headband connecting member provided on the inner surface for readily and releasably securing a hat crown to the headband without destroying or removing the headband connecting member, the hat crown including an open end having a hat crown connecting member secured along an inner surface of the hat crown for attachment to the headband connecting member in a manner permitting the hat crown to extend from the headband, wherein the hat crown is secured to the headband by positioning the hat crown about the headband and folding the hat crown connecting member within the headband such that the hat crown connecting member and the headband connecting member are releasably secured.

10. The modular hat according to claim 9, further including an interchangeable panel hat crown shaped to fit on the head of an individual, the interchangeable panel hat crown including a plurality of straps connected in an intersecting manner to create a plurality of open crown segments; the hat further including a plurality of panels for attachment to the interchangeable panel hat crown in a manner covering the open crown segments, wherein panel connecting members are provided for releasably securing the plurality of panels to the straps of the interchangeable panel hat crown.

11. The modular hat according to claim 10, wherein the panels are shaped to cover at least a single open crown segment.

12. The modular hat according to claim 10, wherein the interchangeable panel hat crown includes a closed end where the straps intersect and an open end, the interchangeable panel hat crown further including a first hat crown connecting member secured at the open end of the hat crown for attachment to the headband connecting member in a manner permitting the hat crown to extend from the headband.

13. The modular hat according to claim 12, wherein the interchangeable panel hat crown includes a closed end where the straps intersect and an open end, the hat crown further including a second hat crown connecting member secured at the open end of the hat crown for attachment of the plurality of panels.

14. The modular hat according to claim 13, wherein the first hat crown connecting member and the second hat crown securing member are semi-circular and extend around only a portion of the headband when the interchangeable panel hat crown is secured to the headband.

15. The modular hat according to claim 10, wherein the interchangeable panel hat crown includes a closed end where the straps intersect and an open end, the interchangeable panel hat crown further including a second hat crown connecting member secured at the open end of the hat crown for attachment of the plurality of panels.

16. The modular hat according to claim 10, wherein the straps intersect to create a plurality of triangle shaped open crown segments.

17. The modular hat according to claim 16, wherein the panels are shaped to cover a single open crown segment.

18. The modular hat according to claim 9, further including a visor having an outwardly extending visor member with a distal end extending away from the headband when the visor is secured to the headband and a proximal end adjacent the headband when the visor is secured to the headband, the visor further including a visor connecting member secured to the proximal end of the visor member for attachment to the headband connecting member in a manner permitting the visor to extend from the headband.

19. The modular hat according to claim 9, further including ear muffs, each ear muff having a distal end extending downwardly over an ear of an individual when the ear muff is secured to the headband and a proximal end adjacent the headband when the ear muff is secured to the headband, each ear muff further including an ear muff connecting member secured to the proximal end of the ear muff for attachment to the headband connecting member in a manner permitting the ear muff to extend from the headband.

20. The modular hat according to claim 9, further including a neck curtain having a distal end extending downwardly over the neck of an individual when the neck curtain is secured to the headband and a proximal end adjacent the headband when the neck curtain is secured to the headband, the neck curtain further including a neck curtain connecting member secured to the proximal end of the neck curtain for attachment to the headband connecting member in a manner permitting the neck curtain to extend from the headband.

* * * * *